US006715851B1

(12) United States Patent
Yang

(10) Patent No.: US 6,715,851 B1
(45) Date of Patent: Apr. 6, 2004

(54) DETACHABLE RAIL ASSEMBLY FOR DRAWERS

(76) Inventor: Jun-Long Yang, No. 33, Da-Hsin 15 St., Tai-Ping City, Taichung Hsien (TW)

( * ) Notice: Subject to any disclaimer, the term of this patent is extended or adjusted under 35 U.S.C. 154(b) by 0 days.

(21) Appl. No.: 10/271,614

(22) Filed: Oct. 15, 2002

(51) Int. Cl.[7] ..... A47B 88/16
(52) U.S. Cl. ..... 312/334.46
(58) Field of Search ..... 312/334.46, 333, 312/333.44, 333.45, 334.11, 334.13, 334.8

(56) References Cited

U.S. PATENT DOCUMENTS 6,126,255 A * 10/2000 Yang ..... 312/334.46
6,257,683 B1 * 7/2001 Yang ..... 312/333
6,386,660 B1 * 5/2002 Yang ..... 312/334.46
6,402,275 B1 * 6/2002 Yang ..... 312/334.46
6,450,600 B1 * 9/2002 Chen et al. ..... 312/334.46
6,454,372 B1 * 9/2002 Yang ..... 312/334.13

* cited by examiner

*Primary Examiner*—Ramon O. Ramirez
(74) *Attorney, Agent, or Firm*—Alan Kamrath

(57) ABSTRACT

A detachable rail assembly for drawers has a track assembly, a rail and a resilient latch. The track assembly is adapted to be attached to a fixture, the rail is slidably mounted in the track assembly and the latch is secured on the rail. A limit block with two locking protrusions is firmly attached to one end of a slide track of the track assembly, and two wings are defined laterally on opposite sides of the latch respectively to abut the locking protrusions. Two ribs are formed on a surface of the latch facing the rail so the rail can be separated by pressing the latch toward the rail easily and the latch is easily for a manufactured.

10 Claims, 9 Drawing Sheets

DETACHABLE RAIL ASSEMBLY FOR DRAWERS

BACKGROUND OF THE INVENTION

1. Field of the Invention

The present invention relates to a detachable rail assembly, and more particularly to a detachable rail assembly for furniture that contains drawers where the detachable rail assembly has a resilient latch with two cylindrical ribs to make the detachment and installation of drawers easy and the manufacturing process simple.

2. Description of Related Art

Detachable rails are usually used to make installing and removing drawers or racks used with a desk more convenient. With reference to FIGS. 8 and 9, a conventional detachable rail assembly includes a U-shaped track (70), a ball bearing race (71), a rail (72) and a resilient latch (73). The track (70) has two ends, is made of metal and is adapted to be securely attached to furniture. The ball bearing race (71) is slidably mounted in the track (70). To prevent the ball bearing race (71) from sliding out of the track (70), a limit block (702) with two locking protrusions (703) parallel to each other and a stop (704) are mounted at opposite ends of the track (70) respectively.

The rail (72) has a first hook (721) and a second hook (722) and is slidably mounted on the ball bearing race (71). The first hook (721) and the second hook (722) are formed by a stamping machine, and a positioning hole (723) is defined underneath the second hook (722) in the rail (72). Two nubs (724) are formed at opposite sides of the positioning hole (723) on the rail (72).

The latch (73) has an outer end (not numbered), an inner end (not numbered), a notch (731) and an inclined segment (732). The inclined segment (732) is formed on the inner end of the latch (73). The notch (731) is formed on the outer end of the latch (73).

The latch (73) is securely mounted between the first and the second hooks (721, 722). A transverse rib (733) corresponding to the positioning hole (723) is formed under the inclined segment (732). Two wings (734) protrude from opposite edges of the inclined segment (732) respectively and are adapted to lock with the locking protrusion (703) of the limit block (702). In assembly, the notch (73 1) is wedged under and around the first hook (721), the inclined segment (732) is forced under the second hook (722), and the transverse rib (733) is held in the positioning hole (723) by the second hook (722).

When the rail (72) is slidably mounted on the ball bearing race (71), the latch (73) is pressed to release the wings (734) from the locking protrusions (703) so the rail (72) can slide out of the ball bearing race (71).

However, the conventional detachable rail assembly has some shortcomings in manufacturing, which include the following.

1. Burrs on the nub (724):

The nub (724) is formed on the rail (72) by stamping. Burrs are often formed when stamping with a die. After extensive use, the stamping die will deform and form sharper burrs during stamping. The burrs may damage the latch (73) or affect the latch (73) during or in assembly. The burrs even may preclude the latch (73) from being attached to the rail (72) between the first and the second hooks (721, 722).

2. Bad pivot effect of the nubs (724):

The nubs (724) act as pivot points so the latch (73) can be pressed easily. Because the nubs (724) are not smooth, the pressure that acts on the nubs (724) is unstable so the pivot effect of the nubs (724) is bad.

To overcome the shortcomings, the present invention provides an improved detachable rail assembly to mitigate and/or obviate the aforementioned problems.

SUMMARY OF THE INVENTION

The main objective of the invention is to provide an improved detachable rail assembly that is easily manufactured.

Another objective of the invention is to provide a detachable rail assembly that is easily detached by a user.

Other objectives, advantages and novel features of the invention will become more apparent from the following detailed description when taken in conjunction with the accompanying drawings.

DETAILED DESCRIPTION OF PREFERRED EMBODIMENT

Figure 1:
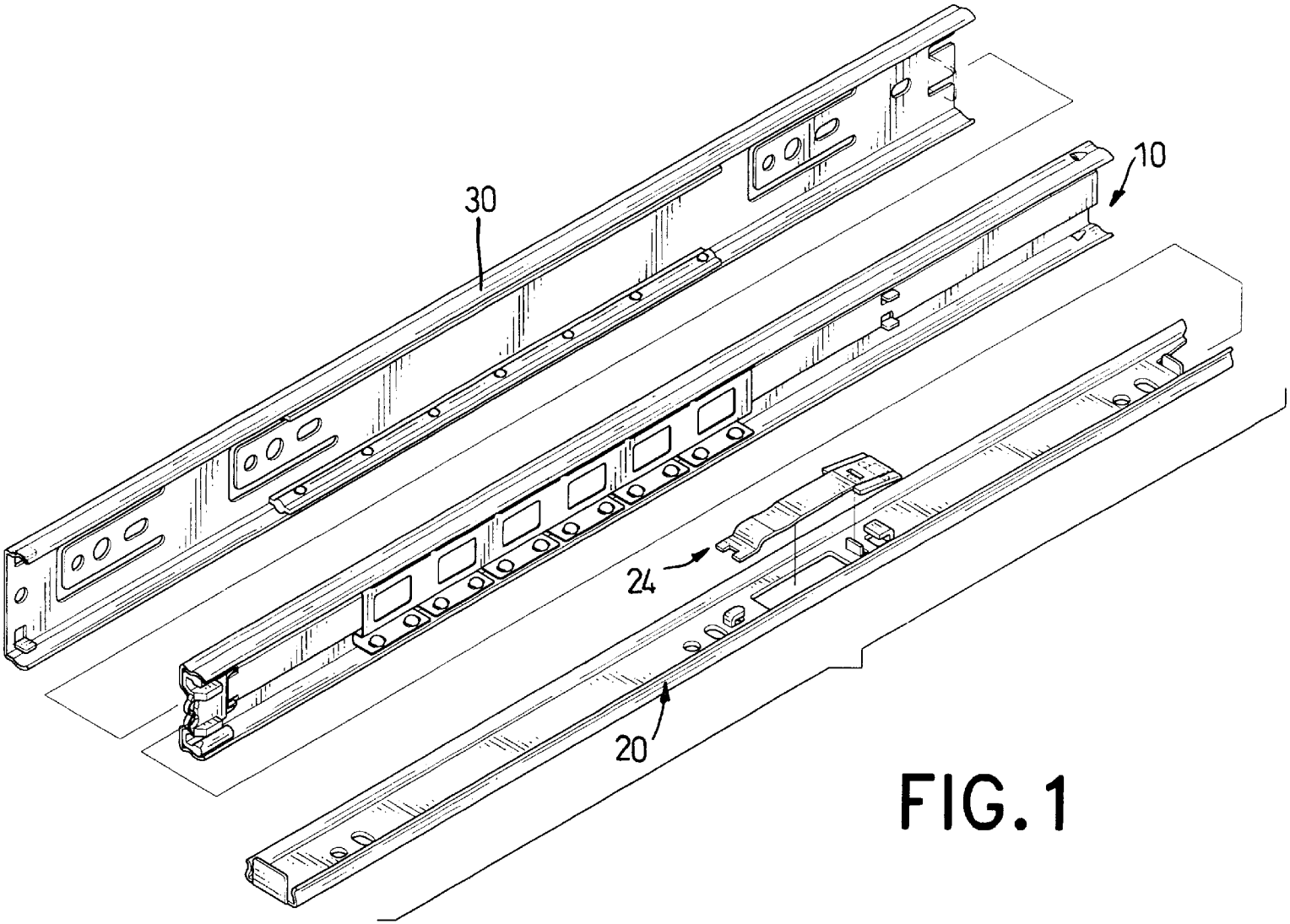
FIG. 1 is an exploded perspective view of a detachable rail assembly for drawers in accordance with the present invention.

With reference to FIG. 1, a detachable rail assembly for drawers in accordance with the present invention includes a track assembly (10), a rail (20) and a resilient latch (24). The track assembly (10) is adapted to securely attach to a sidewall of furniture or a similar fixture. The rail (20) is slidably mounted in the track assembly (10). The latch (24) is mounted on the rail (20) between the rail (20) and the track assembly (10).

Figure 2:
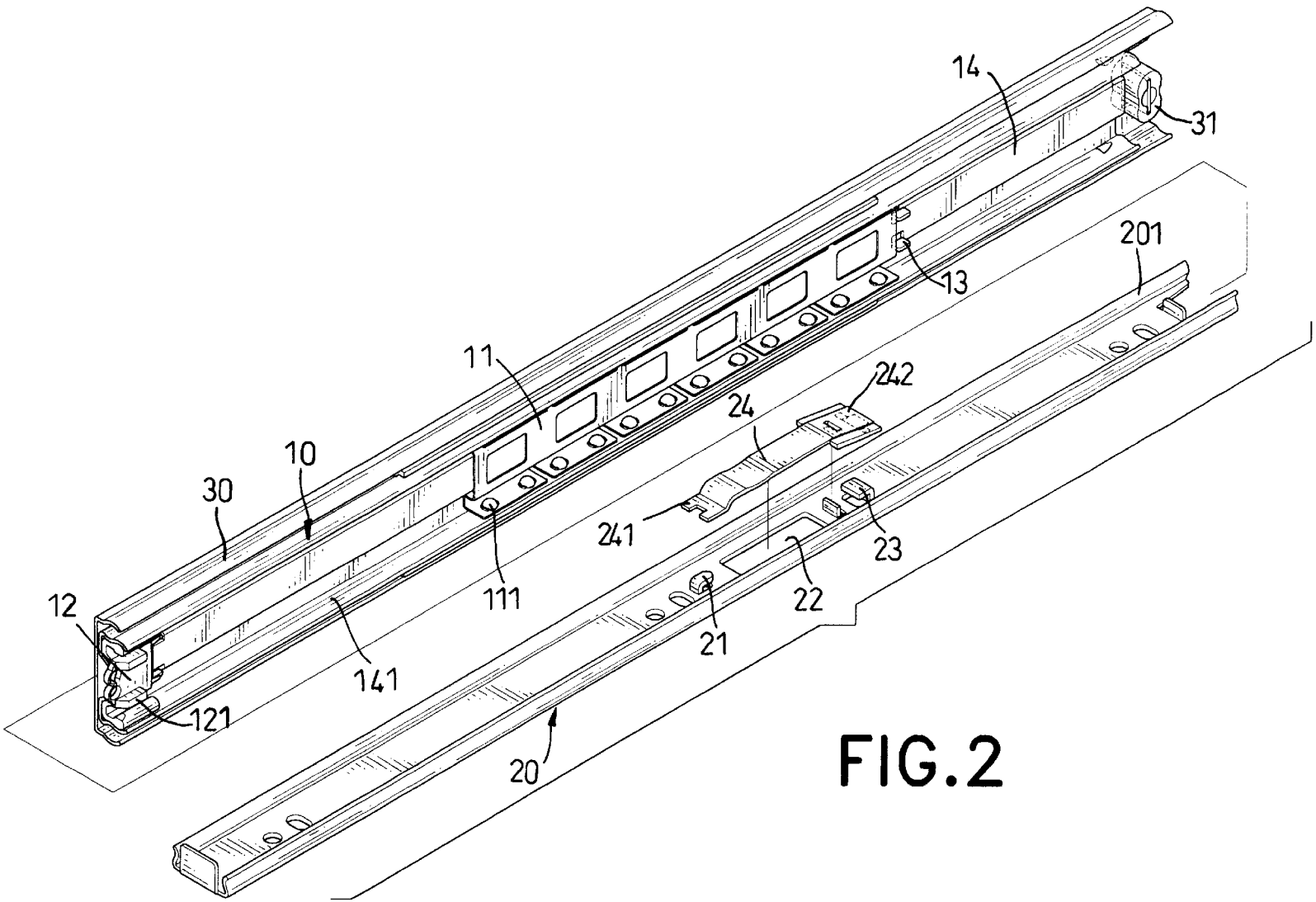
FIG. 2 is an exploded perspective view of the detachable rail assembly in FIG. 1 with the track assembly slidably mounted in the stationary track.
Figure 3:
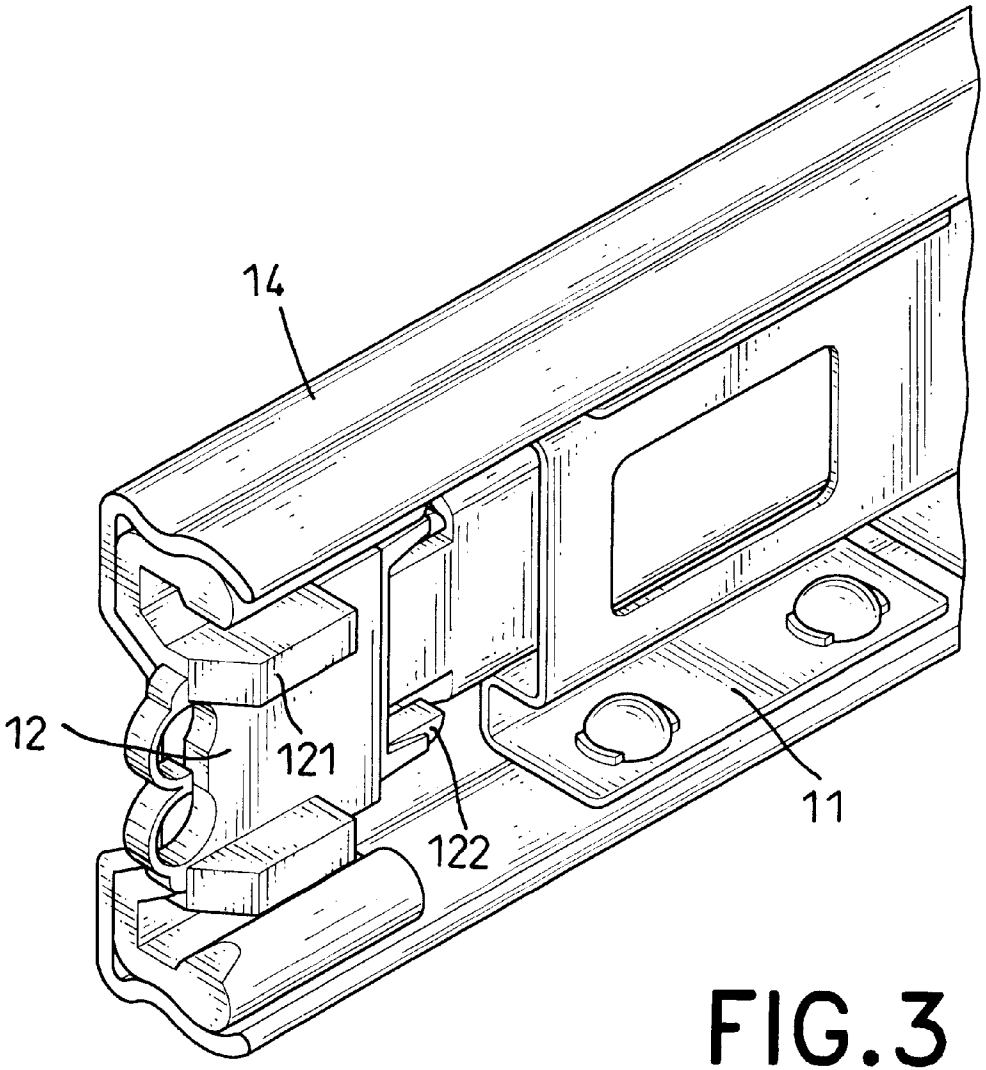
FIG. 3 is an enlarged perspective view of the limit block of the detachable rail assembly in FIG. 1.

With reference to FIGS. 2 and 3, the track assembly (10) includes a slide frame (11), a limit block (12), a stop (13), a U-shaped slide track (14) and a stationary track (30). The slide frame (11) has multiple ball bearings (111) and two opposite sides. Ball bearings (111) are arranged on each side of the slide frame (11). The slide track (14) has an inner end, an outer end and two opposing sidewalls (not numbered)

that serve as tracks (141) for the ball bearings (111). The slide frame (11) is slidably mounted in the slide track (14), and the ball bearings (111) are partially received in the tracks (141).

The stationary track (30) is U-shaped, has an inner end (not numbered), an outer end (not numbered) and two opposing sides and is adapted to be attached to a piece of furniture or a similar fixture.. The slide track (14) is slidably mounted in the stationary track (30). A limit tab (31) is formed on the inner end of the stationary track (30) to prevent the slide track (14) from sliding out of the inner end of the stationary track (30).

With reference to FIG. 3, the limit block (12) has an inner end, an outer end, an inward face, two locking protrusions (121) and two attachment blocks (122). The locking protrusions (121) are formed on the inward face perpendicular to the limit block (12). The two attachment blocks (122) are formed on the inner end of the limit block (12) parallel to each other. The attachment blocks (122) keep the slide frame (11) in position when the slide frame (11) abuts the limit block (12). The limit block (12) is securely attached to the outer end of the slide track (14). The stop (13) is formed perpendicular to the slide track (14) near the inner end of the slide track (14) to limit movement of the slide frame (11).

With reference to FIG. 2, the rail (20) is U-shaped and has an inner end, an outer end, an attachment device and two opposing sides (201) that have concave outer groves the length of the rail (20). The rail (20) is slidably mounted in the track assembly (10) so the concave outer groves in the sides (201) partially hold the ball bearings (111) of the slide frame (11).

Figure 4:
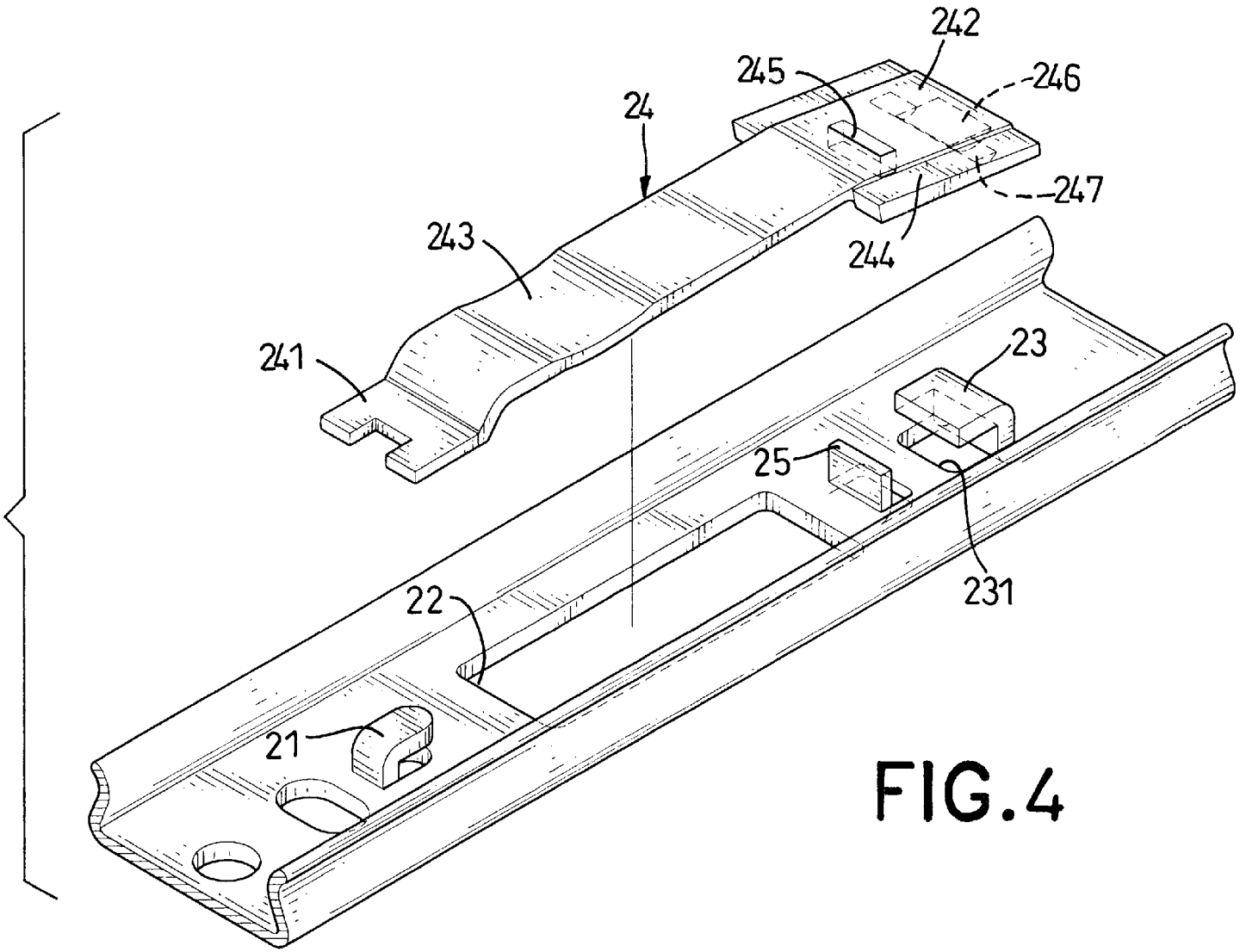
FIG. 4 is an enlarged perspective view of the latch of the detachable rail assembly in FIG. 1.

With reference to FIG. 4, the attachment device is formed on the rail (20) and includes a first hook (21), an opening (22), a second hook (23), a locking hole (231) and a positioning tab (25). The first hook (21) and the second hook (23) face each other. The opening is defined through the rail (20) between the first and the second hooks (21, 23), and the positioning tab (25) is formed on the rail (20) between the second hook (23) and the opening (22). The locking hole (231) is defined in the rail (20) under the second hook (23).

The latch (24) has an outer end, an inner end, a notch (241), an inclined segment (242) and two wings (244). The notch (241) is formed on the outer end, and the inclined segment (242) is formed on the inner end. A concave segment (243) is defined in a raised portion of the latch (24) between the notch (241) and the inclined segment (242) near the notch (241). The two wings (244) respectively protrude laterally from opposite sides of the inclined segment (242). A positioning slot (245) corresponding to the positioning tab (25) is defined in the latch (24) between the wings (244). A nub (246) corresponding to the locking hole (231) is formed under the inclined segment (242) of the latch (24), and a semi-cylindrical rib (247) is defined on each side of the nub (246) and respectively correspond to the wings (244). The semi-cylindrical ribs (247) serve as pivot points and a means of standing the wings (244) off from the rail (20) so the wings (244) can more easily disengage from the protrusions (121) when the latch (24) is pressed.

Figure 5:
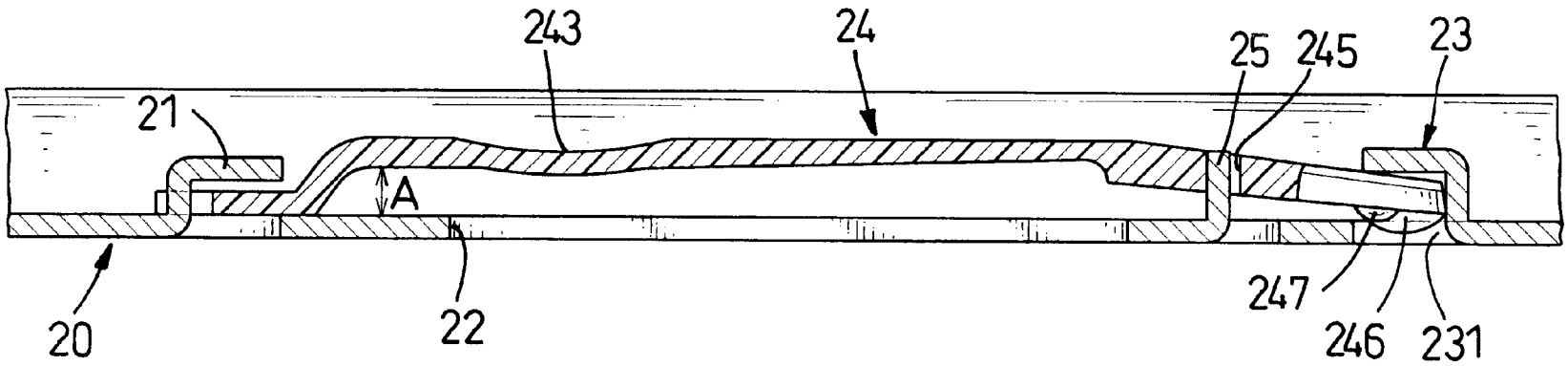
FIG. 5 is an enlarged top plan view in partial section of the latch in FIG. 1 mounted on the rail between the first and the second hooks.

With reference to FIG. 5, the latch (24) is attached to the the attachment device on the rail (20). The notch (241) is mounted under and around the first hook (21), and the inclined segment (242) is securely wedged under the second hook (23). The nub (246) is mounted in the locking hole (231), and the positioning tab (25) is held in the positioning slot (245) to securely hold the latch (24) on the rail (20). A gap (A) exists between the latch (24) and the raised portion of the rail (20) so the latch (24) can be pressed. For convenience of assembly, the opening (22) allows the latch (24) to be pushed by a finger so the latch (24) can be removed.

Figure 6:
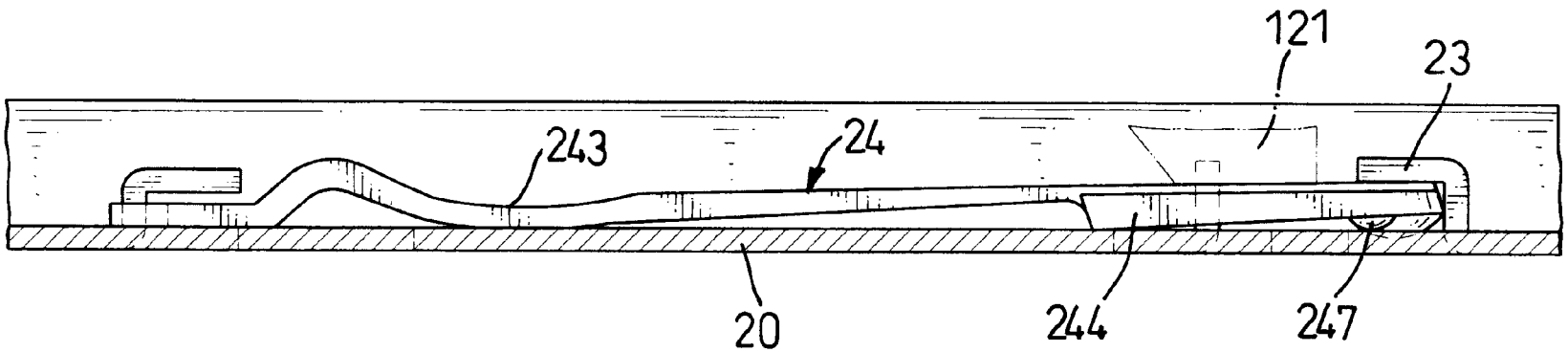
FIG. 6 is an operational top plan view in partial section of the latch in FIG. 5 pressed to release the wings from the locking protrusions.

When the rail (20) is drawn out, the wings (244) of the latch (24) abut the locking protrusions (12 1) of the limit block (12) when the concave segment (243) of the latch (24) is not pressed so the rail (20) is always held on the track assembly (10). With reference to FIG. 6, the wings (244) do not abut the locking protrusions (121) when the latch (24) is pressed toward the rail (20). Thus, the rail (20) can be drawn out and separated from the track assembly (10) without a problem. The concave segment (243) is a perfect area to be pressed because the ribs (247) act as pivot points to allow the wings (244) to move beyond parallel and easily disengage from the protrusions (121). Consequently, a user can press the latch (24) toward the rail (20) to easily draw out the rail (20).

Figure 7:
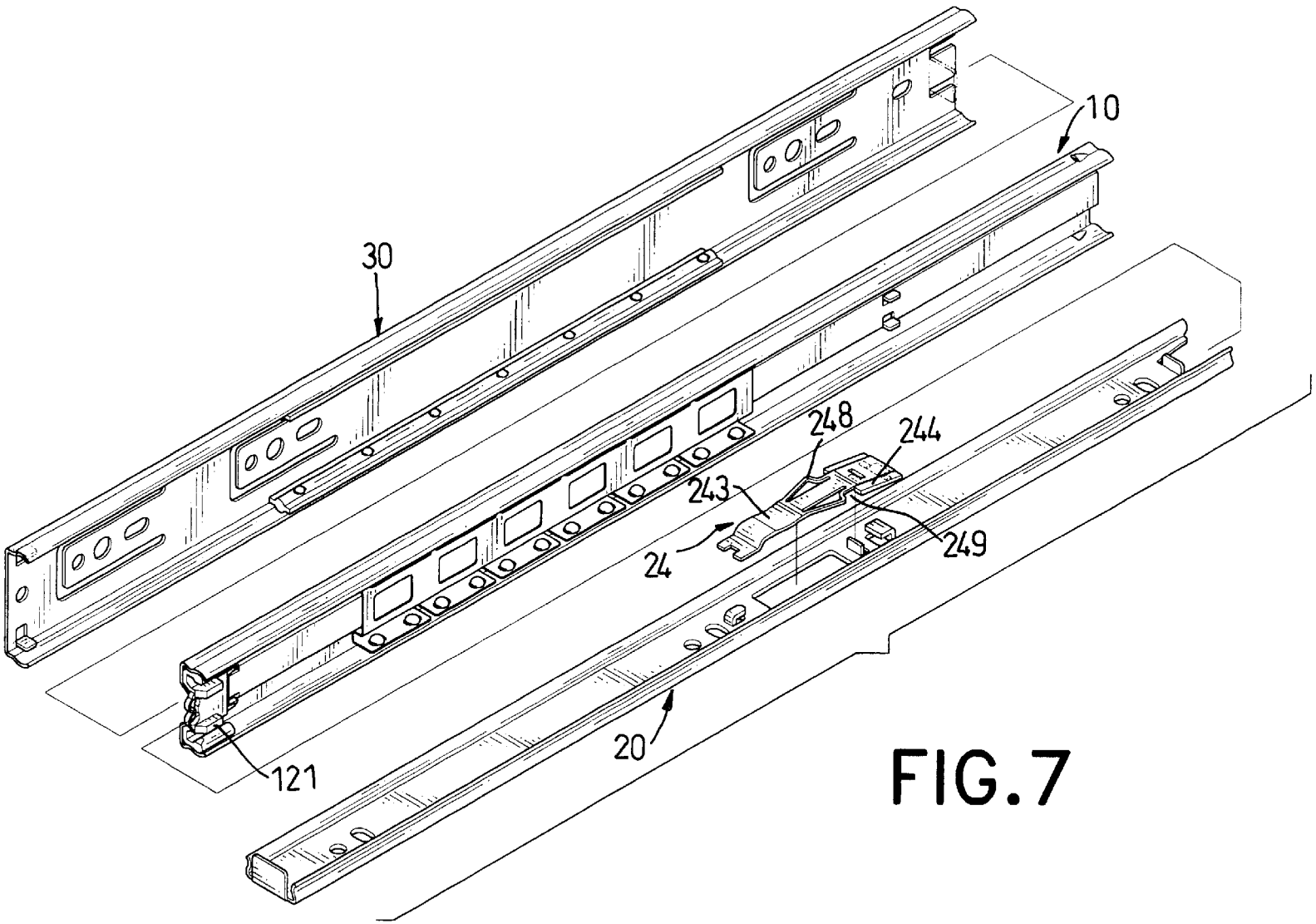
FIG. 7 is an exploded perspective view of an alternative embodiment of the detachable rail assembly in accordance with the present invention.
Figure 8:
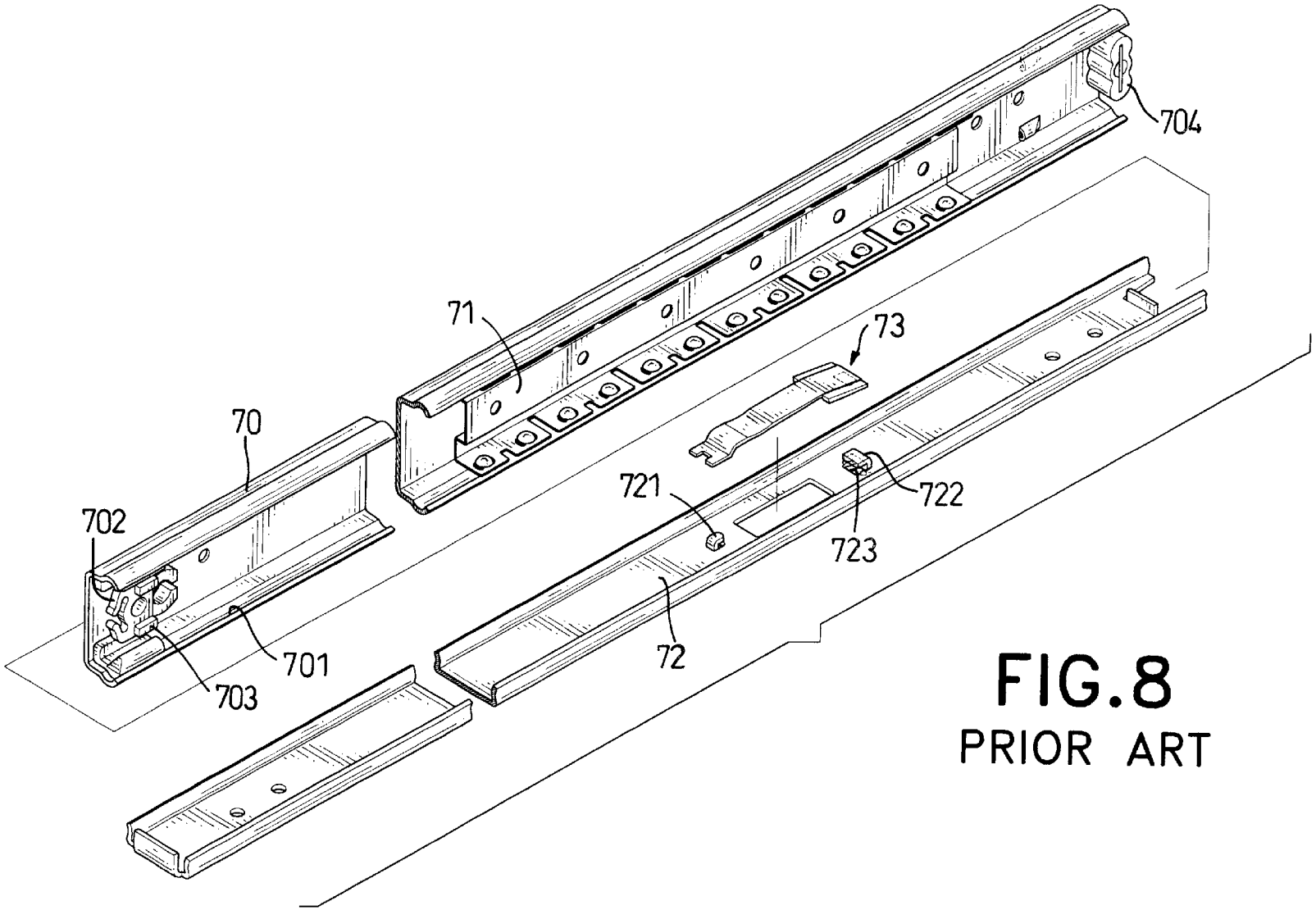
FIG.8 PRIOR ART
FIG. 8 is an exploded perspective view of a conventional detachable rail assembly in accordance with the prior art.
Figure 9:
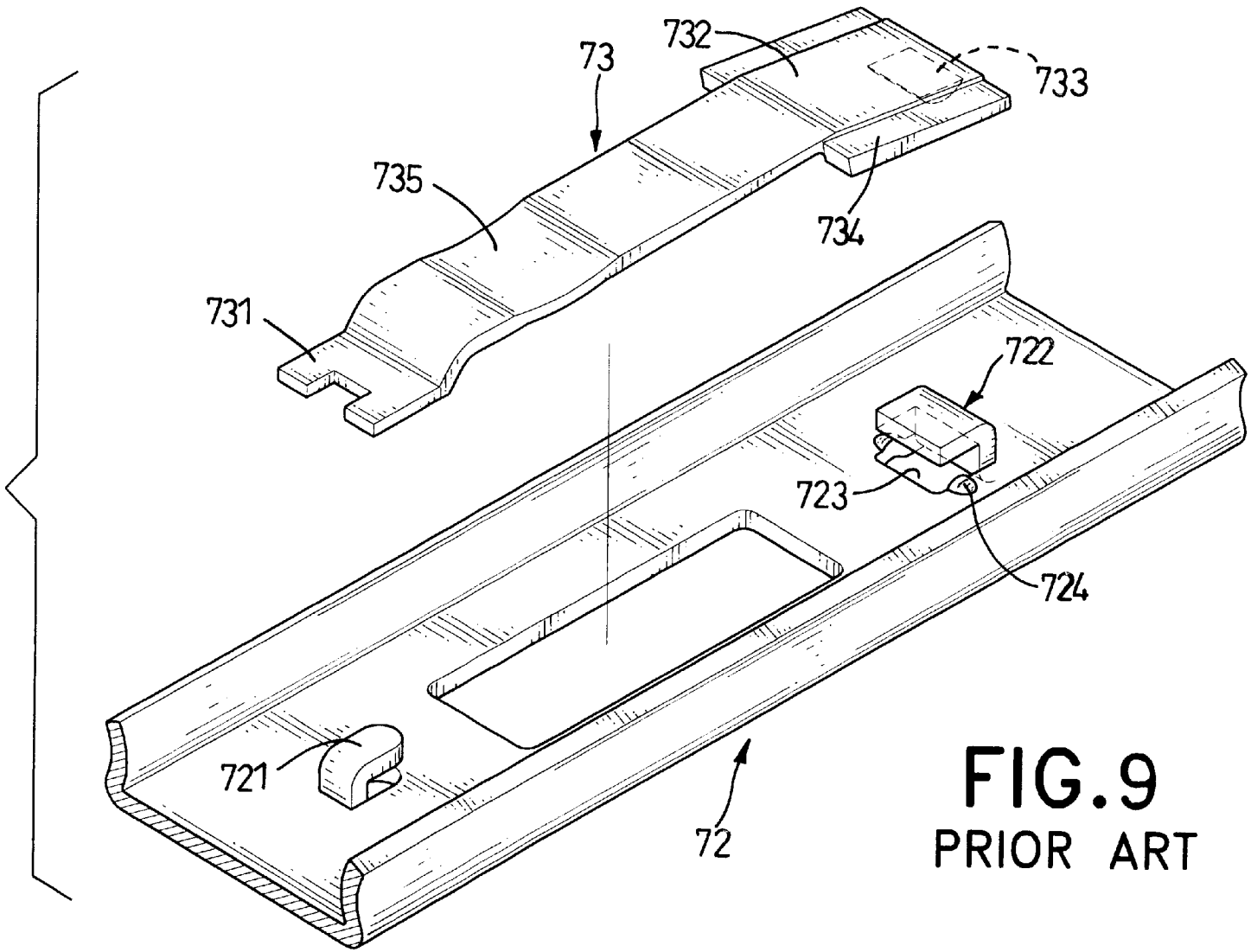
FIG. 9 PRIOR ART
FIG. 9 is an enlarged exploded perspective view of the latch in FIG. 8.

With reference to FIG. 7, the latch (24) can be configured with two ears (248) respectively formed laterally on opposite sides of the latch (24) between the wings (244) and the concave segment (243). The ears (248) cause spaces (249) to be defined between each ear (248) and the corresponding wing (244). In this embodiment, the locking protrusions (121) held in the corresponding spaces (249) when the rail (20) is drawn out so the rail (20) can be positively held in position.

As described, the detachable rail assembly for drawers has the following advantages:

1. Solves the burr problem for the nubs (724):

The ribs (247) are directly formed on the latch (24) and both the latch (24) and the rib (247) can be made of plastic so the latch (24) and the rib (247) are easily manufactured. There is no a burr problem with the latch (24) and the rib (247) because they are made by plastic injection molding.

2. Excellent pivot effect:

The semi-cylindrical rib (247) provides a stable pivot because the cylindrical rib (247) is bigger and has a larger contact area than stamped nub (724). The pressure acting on the rib (247) is uniform so the user can press the latch (24) easily.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A detachable rail assembly for drawers and the detachable rail assembly comprising:

a track assembly adapted to be attached to a sidewall of furniture and the track assembly comprising a slide track having an inner end, an outer end and two opposing sidewalls, and two guides formed at the two sidewalls respectively;

a slide frame having an outer end and an inner end and slidably mounted on the slide track, and the slide frame having multiple ball bearings arranged on the slide frame, the ball bearings partly received in the guide of the slide track to allow the slide frame to move; and a limit block attached to the outer end of the slide track and a stop corresponding to the limit block formed on the inner end of the slide frame so movement of the slide frame is limited on the slide track, and the limit block having two locking protrusions respectively formed on two opposite sides of the limit block;

a rail slidably mounted in the slide frame and adapted to be attached to a drawer, the rail having two sides with outer concave groves formed on two long sides of the rail to hold the ball bearings of the slide frame; and an attachment device formed on the rail; and a resilient latch attached to the rail by the attachment device and the latch with an outer end and an inner end having a notch formed at the outer end of the latch to attach to the attachment device;

an inclined segment formed at the inner end of the latch and having a nub under the inclined segment and the inclined segment held by the attachment device; and two wings respectively protruding laterally from opposite sides of the inclined segment ot abut with the locking protrusions;

two ribs respectively formed on opposite sides of the nub under the inclined segment;

wherein, a gap is defined between the latch and the rail so the latch can be pressed to release the wings from the locking protrusions and the rail is easily separated from the track assembly.

2. The detachable rail assembly as claimed in claim 1, wherein the track assembly further comprises a stationary track adapted to be attached to a sidewall of furniture or a similar fixture; and a limit tab defined at the inner end of the stationary track, wherein the slide track is slidably mounted on the stationary track.

3. The detachable rail assembly as claimed in claim 1, wherein the attachment device further comprises a first hook formed on the rail to hold the notch;

a second hook facing the first hook and formed on the rail to hold the inclined segment;

an opening defined through the rail between the first and second hooks; and a locking hole formed under the second hook to hold the nub under the inclined segment.

4. The detachable rail assembly as claimed in claim 2, wherein the attachment device further comprises a first hook formed on the rail to hold the notch;

a second hook facing the first hook and formed on the rail to hold the inclined segment;

an opening defined through the rail between the first and second hooks; and a locking hole formed under the second hook to hold the nub under the inclined segment.

5. The detachable rail assembly as claimed in claim 3, wherein a positioning tab is formed on the rail between the opening and the second hook, and a positioning slot is defined in the latch to hold the positioning tab.

6. The detachable rail assembly as claimed in claim 4, wherein a positioning tab is formed on the rail between the opening and the second hook, and a positioning slot is defined in the latch to hold the positioning tab.

7. The detachable rail assembly as claimed in claim 5, wherein a concave segment is defined in a raised portion of the latch near the first hook.

8. The detachable rail assembly as claimed in claim 6, wherein a concave segment is defined in a raised portion of the latch near the first hook.

9. The detachable rail assembly as claimed in claim 7, wherein the rib is semi-cylindrical.

10. The detachable rail assembly as claimed in claim 8, wherein the rib is semi-cylindrical.

* * * * *